United States Patent [19]

Oki et al.

[11] 4,269,528

[45] May 26, 1981

[54] FOUNTAIN PEN WITH SPECIFIC TUBULAR NIB

[75] Inventors: Takeo Oki, Hatano; Shunichi Hirosawa, Hiratsuka, both of Japan

[73] Assignee: Pilot Man-Nen Hitsu Kabushiki Kaisha, Tokyo, Japan

[21] Appl. No.: 138,428

[22] Filed: Apr. 8, 1980

Related U.S. Application Data

[63] Continuation of Ser. No. 907,336, May 18, 1978, abandoned.

[30] Foreign Application Priority Data

May 19, 1977 [JP] Japan ..... 52/63295
May 19, 1977 [JP] Japan ..... 52/63296
May 19, 1977 [JP] Japan ..... 52/63297

[51] Int. Cl.[3] ..... B43K 1/06; B43K 9/00

[52] U.S. Cl. ..... 401/231; 401/225; 401/241; 401/244; 401/251

[58] Field of Search ..... 401/237–239, 401/240–251, 221–229, 231–233, 236, 234, 235; 15/445, 447

[56] References Cited

U.S. PATENT DOCUMENTS

| | | | |
|---|---|---|---|
| 1,717,001 | 6/1929 | Benson | 401/246 X |
| 1,876,151 | 9/1932 | Sager | 401/249 |
| 2,432,112 | 12/1947 | Lovejoy | 401/227 |
| 2,474,996 | 7/1949 | Wallis | 401/227 X |
| 2,521,657 | 9/1950 | Severy | 401/243 X |
| 3,101,075 | 8/1963 | Johmann | 401/243 X |
| 3,292,596 | 12/1966 | Ishida | 401/251 |
| 3,411,854 | 11/1968 | Rosler et al. | 401/227 |
| 3,467,476 | 9/1969 | Konig | 401/244 |
| 3,532,436 | 10/1970 | Konig | 401/227 |
| 3,606,556 | 9/1971 | Green et al. | 401/231 |

FOREIGN PATENT DOCUMENTS

| | | | |
|---|---|---|---|
| 241806 | 11/1962 | Australia | 401/226 |
| 1213296 | 3/1966 | Fed. Rep. of Germany | 401/248 |
| 1354195 | 1/1964 | France | 401/244 |

*Primary Examiner*—Steven A. Bratlie
*Attorney, Agent, or Firm*—Wenderoth, Lind & Ponack

[57] ABSTRACT

A tubular nib having a beak-shaped section at one end of a tube, a slit formed in the beak-shaped section, and a slit-widening inhibiting section having a radius of curvature larger than that of the tubular part of the tubular nib at least at the section across the innermost end of the slit in the beak-shaped part of the tubular nib.

14 Claims, 24 Drawing Figures

FOUNTAIN PEN WITH SPECIFIC TUBULAR NIB

This is a Continuation of application Ser. No. 907,336, filed May 18, 1978 now abandoned.

BACKGROUND OF THE INVENTION

This invention relates to fountain pens.

Fountain pens are known which have tubular nibs which are produced by tapering a tube so that it narrows as one goes from one end to the other of said tube, with an ink feed inserted in said tube, forming the narrower end of the tube into a beak-shape, slitting said beak-shaped section to form a writing section integrated with the other part of the tube, and providing a threaded section to connect the rear barrel of the fountain pen to the other end of said tube.

In the manufacture of such tubular nibs using tapered tubes, use of tubes with small diameters is generally unavoidable, since the tubular nibs are used in the writers' hands and therefore, the thickness of the tube to be used is restricted. In addition, the writing section formed in the beak-shaped part of a tapered tube has a small width. Thus, the writing section of a conventional tubular nib has a small radius of curvature, and is thin and has a small width. This means that the slit formed in the writing section to lead ink widens easily under pressure during writing because larger components of reaction force against the writing pressure, in directions tending to widen the slit, are created in the writing section as the radius of curvature of the tubular nib is made smaller. The widened slit, in turn, loses its capillary action, and becomes unable to feed ink. This problem of fountain pens becoming incapable of writing occurs only with conventional tubular nibs; it is never encountered in the use of common nibs. The reason lies in the fact that common nibs are not tubular and have radii of curvature much larger than do tubular nibs, and thus they allow free selection of radii of nib curvature. Despite these drawbacks, however, tubular nibs have the advantage that the ink feed is covered by the tubular nib and prevents the ink from evaporating, since the feed is not exposed to the surrounding air.

SUMMARY OF THE INVENTION

This invention seeks to make effective use of the advantages of tubular nibs and to resolve the abovementioned problems inherent in conventional tubular nibs.

A further objective of this invention is to provide fountain pen nibs which consist of a minimum number of component parts, which have a simple structure, and which can be used reliably without causing any problems.

Still another objective of this invention is to provide fountain pens which permit quick and easy assembly, have a solid structure, and consist of component parts with very simple structures.

With these objectives to be attained, this invention, which provides a tubular nib produced by forming one end of a tube into a beak shape and by slitting the beak-shaped section to form a writing section, is particularly characterized by the fact that a slit-widening inhibiting section is provided which has a radius of curvature larger than that of the tubular part of the tubular nib at least at the section across the innermost end of the slit.

The radius of curvature of the slit-widening inhibiting section at the section across the innermost end of the slit, which is larger than that at the tubular part, is used because of the effect which is attainable with this configuration which prevents the slit from widening excessively even under high pressure which may be applied during writing and because it provides high elasticity. It will be understood that when the radius of curvature becomes larger, the elastic tips of the writing section separated by the slit will tend to be elastically deformed under writing pressure in directions forming smaller angles to a plane passing through the slit and the longitudinal axis of the tubular nib. This means that the larger the radius of curvature is, the smaller is the components of force tending to move the elastic tips away from each other. Tubular nibs formed integrally with front barrels tend to cause the writing hand of the user to slip toward the paper being written on due to the tapered tubular shape of the nib narrowing as one goes toward the tip. However, the provision of a flat section or a curved surface section with a large radius of curvature on the upper surface of the nib forms ridges between said curved surface and the surface of the tubular section of the nib, which, in turn, prevent the fingers of the user from slipping, especially when the ridges extend over the entire axial length of the nib. Slip prevention may further be effected by making the gripping section of the nib coarse such as by grooving, graining or honing, or coating it with a resin having a high coefficient of friction. The use of a curved surface is also effective for preventing the fountain pen from rolling.

The curved surface with a large radius of curvature which is formed on the nib in accord with the principles of this invention may extend from the writing section located on the upper surface of said nib to the end of the nib which is farthest from said writing section. It is desirable that the curved surface with a large radius of curvature extend at least from the innermost end of the slit to the writing end. In cases where the curved surface covers part of the region extending from the writing section to the rear-end of the nib, ridges are formed between said large curvature-radius curved surface or flat section and the tubular section of the nib. In this case, there is little chance that the interior of the cap in which the nib is inserted will come into contact with the nib slit, thus preventing the ink drawn by the slit from contaminating the inner wall of the cap. This is highly advantageous, since it prevents eventual ink contamination of the nib and the rear barrel to which the cap are attached. The abovementioned large radius of curvature surface provided on the nib may be of the same width from the end nearest to the tip of the nib to the other end, or may have a width larger at one end than that at the other end, i.e., wider at the end of the curved surface nearest the tip of the nib than at the other end, or vice versa. The length and width of such a large radius of curvature surface are selected depending upon the external diameter and material of the tube used. The nib shape can be formed by draw forming.

These nibs, with an ink feed inserted and a connecting section used to connect the nib to the rear barrel formed at the rear end of said nib, can serve as fountain pen nib assemblies which consist of a minimum number of parts, have a simple structure, and are quite reliable in use.

In this case, the ink feed may be a commonly used structure, but it is desirable that the feed be joined to the nib by means of a suitable connection method for structural stability. For example, satisfactory results are obtained when the feed is inserted removably into an inner tube, and this inner tube, in turn, is inserted and fixed inside the nib by use of an adhesive. The connecting section of the nib is formed at the end of the nib farthest from its tip by processing said end directly, forming a threaded section. Alternatively, the connecting sections may be separate parts which are joined with said end of the nib. For example, use can be made of a coupling tube having threaded sections at both ends. In short, any means of connecting may be used as long as it ensures satisfactory connection of the nib with the rear barrel of the fountain pen.

These nibs and nib assemblies become usable as fountain pens when they are connected with rear barrels by said connecting means and fitted with caps.

Caps of fountain pens, while protecting the nibs from damage, have the principal function of preventing evaporation of the water from water-based inks used in them. The caps are frictionally or threadedly engaged with the barrel for detachable engagement therewith. Usually there is a hermetically sealed relation between the cap and the barrel to prevent an accumulation of dried dye from the writing fluid clogging the ink channels and preventing normal writing action.

A method of cap engagement can be used in which three projection-receiving notches are formed in the circular end of the nib, and an open ring or arcuate spring is provided which has a fixing central projection located at a position diametrically opposite to the circumferential opening of the arcuate spring and which has two cap-engaging side projections located at equal distances from said fixing projection, symmetrically located with respect to a diameter extending from the fixing projection to the middle of the circumferential opening, said arcuate spring being placed at the circular end section of the nib and the cap-engaging projections being fitted into and projected through the projection-receiving notches of the nib. In this case, a round groove is formed in the internal wall of the cap which engages said cap-engaging projections. In this cap-engaging device, the fixing projection, by fitting into its corresponding projection-receiving notch, helps support the arcuate spring so that it can be fixed firmly in the circular end section of the nib. This ensures smooth passage of the two cap-engaging projections, which face each other and are at equal distances from said fixing projection, through the other two projection-receiving notches. Because of this, the cap can be fitted over, or withdrawn from, the nib easily and faultlessly. Thus, this cap-engaging device is easy to assemble, has a solid and simple structure, and therefore its use is quite advantageous. It is desirable that the arcuate spring shape be formed by blanking.

Fountain pen caps covering the nibs are usually fitted with clips. This invention proposes to use the following cap clip-fitting structure. That is, a head is formed on the upper part of the clip, and the upper surface of said head is processed into a plateau or a raised surface with a lowered surface which is at a level lower than the upper surface of said plateau. A spring-engaging notch is formed in the lower surface of said head section. A slot is formed in the top part of the cap by cutting part of the top and side walls of the cap, wherein the edge of said slot in the cap top is made round so that the slot will allow the plateau of the clip head to fit into it. Assembly starts with insertion of the clip head into the slot so that said lowered surface of the nip head will be level with the lowest edge of the round edge of the slot. Then, one end of a spring is fixed in the spring-engaging notch located in the clip head in the cap. Finally, the other end of said spring is brought into contact with the inner surface of the side wall of the cap so that the clip will be pressed toward the interior of the cap.

In this configuration, the lowered surface of the clip head does not necessarily have to be given a large length in the direction perpendicular to the axis of the clip, since the lowered surface accompanying said plateau contacts and presses against the inner surface of the cap top. A clip head with a large width, therefore, will not fall out of the cap, and can be fitted near the periphery of the cap top part. This makes possible a solid and faultless clip-fitting structure. Also, the insertion of the plateau into the round edge of the slot reduces loosening of the clip, since shaking the clip will cause the plateau to rub against the round end.

The round edge of the slot and the plateau may be concentric and semicircular in shape. However, similar effects may be obtained when either the round end or the plateau are formed into a long semi-ellipical shape so that a small gap will be formed between the round slot edge and the plateau. Another method producing identical effects is one in which the plateau is given wedge-shaped edges so as to engage a V-shaped edge of the slot.

Although either bending or coining may be used to produce the clip, the use of a coining process is recommended since it results in formation of sharp plateau edges.

The cap top may have a rectangular or other cross-section, but best effects are obtained when the cross-section is circular.

For the spring, use can be made of a leaf spring or a wire spring. One end of the spring is fixed inside the cap by fixing the clip and the spring by means of an inner cap which is inserted into the cap after setting said clip and spring at their predetermined positions inside the cap. In short, use of a means which ensures firm fixing of the spring end inside the cap is effective.

The other objectives, characteristics and advantages of this invention will be clearly understood from the following description.

DETAILED DESCRIPTION

Figure 1:
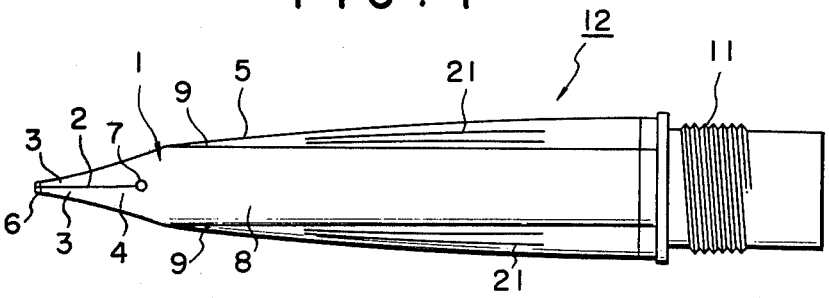
FIG. 1 is a plan view of a fountain pen nib incorporating the principles of this invention.
Figure 2:
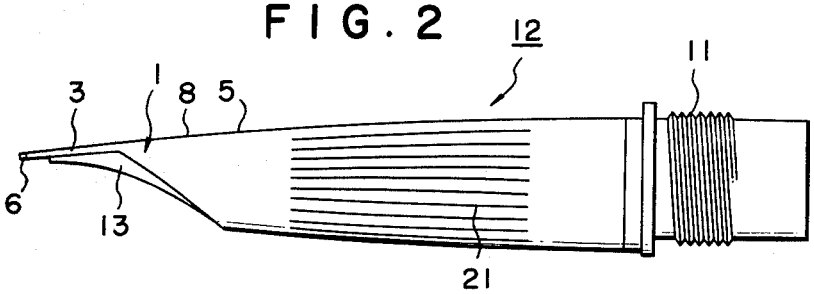
FIG. 2 is a side view of the nib shown in FIG. 1.

Tubular nib 1 of a fountain pen shown in FIGS. 1 through 4 is made of a metal barrel 5 which is produced by forming the narrower end of a tapered metal tube into a beaked shape, and forming a slit 2 therein leaving elastic tips 3 separated by said slit 2 so as to make up a writing section 4. A writing point 6 is provided at the pointed end of the writing section 4, while a central hole 7 is formed at the innermost end of the slit 2.

The upper surface of the nib 1 is made into a curved surface having a radius of curvature larger than that of the barrel 5. A slit widening inhibiting section 8 is formed by shaping said curved surface to give it the same width from the writing section 4 located on the upper surface of the barrel 5 to the rear end of said barrel 5. The slit-widening inhibiting section 8 is separated from the round side of the barrel 5 by ridges 9 formed between said width adjusting section 8 and the round side of the barrel.

Figure 3:
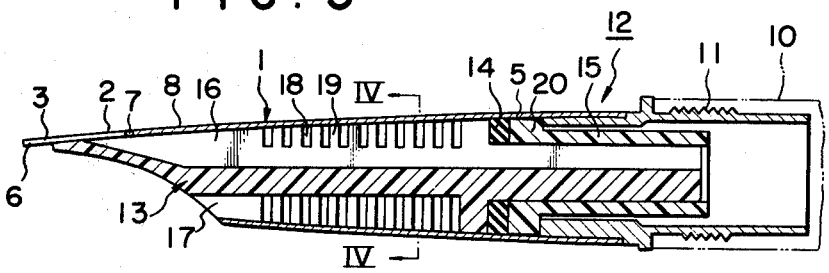
FIG. 3 is a longitudinal sectional view of the nib shown in FIG. 1.
Figure 4:
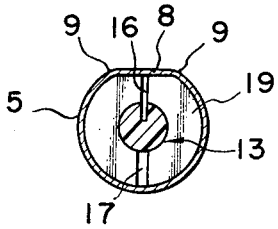
FIG. 4 is a sectional view taken along the line IV—IV of FIG. 3.
Figure 5:
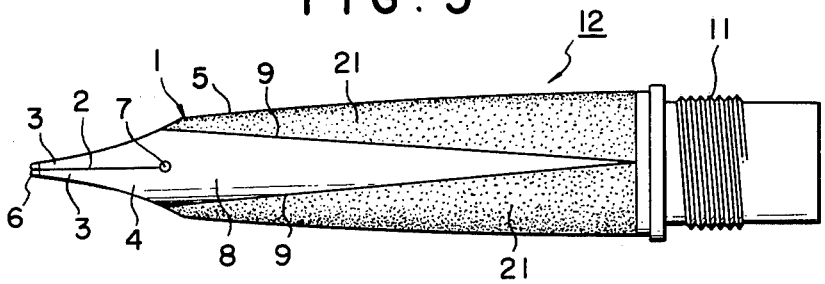
FIG. 5 is a plan view of another embodiment of a fountain pen nib incorporating the principles of this invention.
Figure 6:
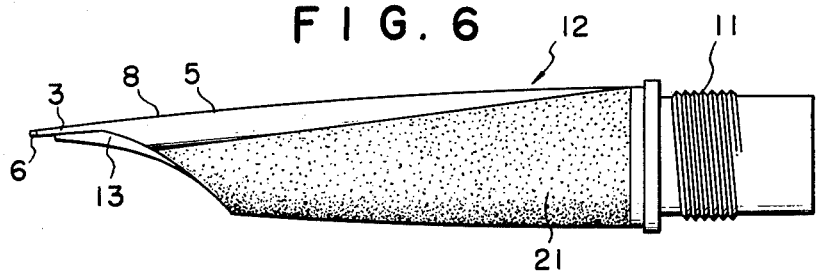
FIG. 6 is a side view of the nib shown in FIG. 5.
Figure 7:
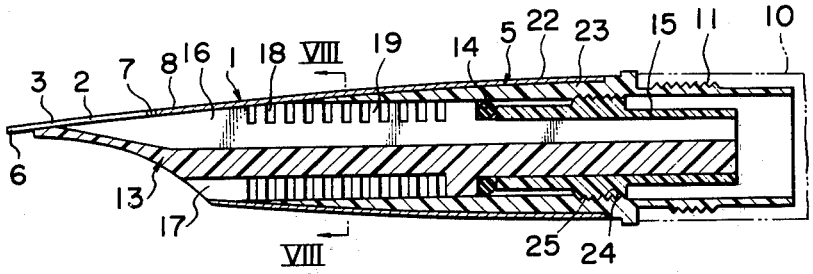
FIG. 7 is a longitudinal sectional view of the nib shown in FIG. 5.
Figure 8:
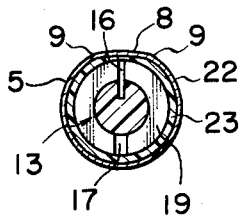
FIG. 8 is a sectional view taken along the line VIII—VIII of FIG. 7.
Figure 9:
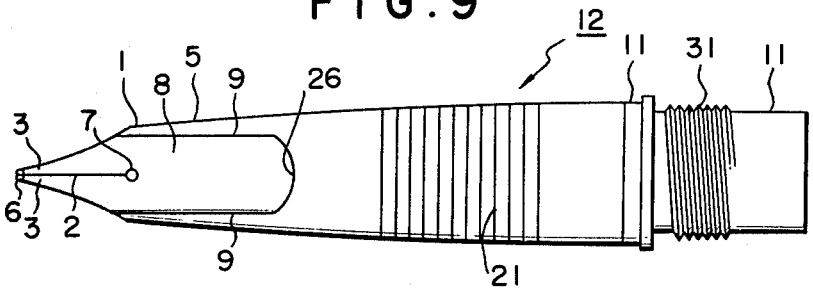
FIG. 9 is a plan view of a further embodiment of a fountain pen nib incorporating the principles of this invention.
Figure 10:
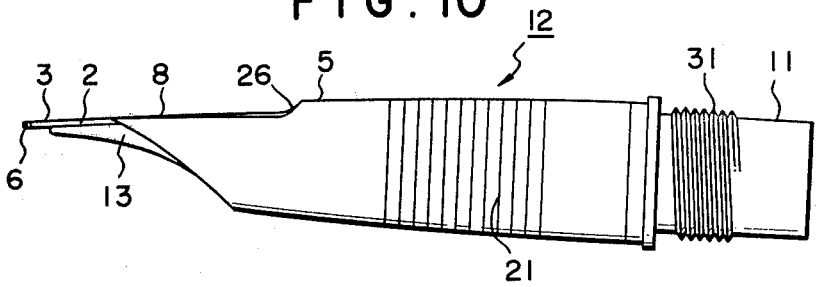
FIG. 10 is a side view of the nib shown in FIG. 9.

A nib assembly 12 is formed by fitting into the nib 1 an ink-feed means to lead ink from the ink reservoir to the slit 2 and a rear barrel connector 11 to connect to the rear barrel 10 which is shown by the dashed-dotted line in FIG. 3.

In this embodiment of the invention, the ink-feed means consists of an ink feed member 13 made of plastic, an annular ink sealing packing 14 made of rubber or plastic, and a tubular ink reservoir connector 15 which is made of plastic and connects to the reservoir or ink cartridge. The ink feed member 13 controls ink flow, and has an ink duct 16 connecting the ink reservoir with the writing section 4 and an air duct 17. These ducts 16 and 17 are of capillary size and balance the external and internal pressures of the ink reservoir. The ink feed member 13 is further provided with an ink-overflow accommodating space which is connected to the air duct 17 and which accommodates overflowing ink which is in excess of that needed for writing. In this embodiment, use is made of annular comb cuts 18 as the ink-overflow accommodating space. The ink feed member 13 has the external surfaces of the annular rims 19, which are left as a result of the formation of the comb cuts 18, fitted against the inner surface of nib 1. The annular packing 14 and the tubular connector 15 having a flange 20 are fitted to the rear section of the ink feed member 13; one end of the rear barrel connector 11 is fixed inside nib 1 by means of an adhesive, etc. so that said end of the connector 11 will come into contact with the flange 20 of the ink reservoir connector 15. This makes the ink-feed means immobile with respect to the nib 1. For the rear barrel connector, use can be made of a brass coupling tube or other suitable coupling tubes.

The slit-widening inhibitor section 8 has a radius of curvature larger than that of the barrel 5. Hence, the writing section 4 with the slit-widening inhibitor 8 is free from the problem of excessive widening of the slit 2, even in cases where strong pressure is applied resulting in large inflection of the point during writing. This leads to a high elasticity in the whole writing section 4, results in good writing touch, and enables both thick and thin letters to be written freely. Furthermore, the provision of rear barrel connector 11 which connects the rear barrel 10 to the rear end of nib 1 effects easy coupling of the nib assembly 12 with the rear barrel 10. A number of parallel grooves may be cut round the nib in the direction of the axis thereof to form a slip-prevention section 21. This produces synergistic slip prevention effects by said grooves and the ridges 9 which are formed between the slit-widening inhibiting section 8 and the round side of the front barrel 5.

The nib 1 shown in FIGS. 5 through 8 differs from that of FIGS. 1 to 4 in the form of the slit-widening inhibiting section and in that it has a laminated barrel.

That is, the laminated barrel 5 consists of an external tube 22 having a slit-widening inhibiting section 8 and a tubular inner tube 23 which is fixed into said external tube 22 by means of an adhesive. The upper surface of the external tube 22 is made into a curved surface which has a radius of curvature larger than that of the barrel 5, and which extends from the writing section 4 located on the upper surface of the barrel 5 to the rear end of said barrel 5. Here, the slit-widening inhibiting section 8 has a width narrowing as it goes from the writing section 4 to the rear end of the barrel 5.

The inner tube 23 is made of plastic, and has an external shape the same as the internal shape of the external tube 22. A threaded section 24 is formed in the rear inner wall or a coupling section of the inner tube 23 for the purpose of coupling with the rear barrel 10 which is shown by the dashed-dotted line in FIG. 7. The internal diameter of the inner tube 23 is constant in the direction of the axis thereof.

A nib assembly is formed by inserting an ink-feed means into the inner tube 23 of the nib 1. As is true with the nib assembly of the above-described embodiment, this embodiment uses an ink-feed means consisting of an ink feed member 13, an annular packing 14 and an ink reservoir connector 15. The ink feed member 13 has the external surfaces of the rims 19, which are left between the comb cuts 18, fitted against the inner surface of inner tube 23. The connector 15 has a threaded section 25 to engage threaded section 24 of the inner tube 23. The ink feed member 13 is inserted to a predetermined depth into the inner tube 23; the packing 14 is fitted to the rear of the feed member 13; connector 15 is screwed into the inner tube 23 using threaded sections 24 and 25; this makes the ink-feed means immobile with respect to the nib 1. Also, a slip preventing section 21 is formed by graining the exterior of the nib excluding the writing section 4 and the slit-widening inhibiting section 8.

With this assembly, the writing section 4 functions in the same manner as does the writing section of the first described embodiment. Since this assembly has the inner tube 23 inserted in the external tube 22, however, it is unnecessary to bring the external shape of the rims 19 formed on the feed member 13 into agreement with the shape of the internal surface of the internal tube 23. This makes ink-feed processing easier.

The nib shown in FIGS. 9 through 12 also has a laminated barrel but differs from the nib of the second embodiment in the shape of the slit-widening inhibiting section and in that use is made of a rear barrel connector with a threaded section to attach said rear barrel connector to, and detach it from, the nib freely.

That is, a slit-widening inhibiting section 8 is formed by processing the upper surface of the writing section 4 on the external tube 22 into a plane, with said plane extending from the writing section 4 located on the external tube 22 to the front end of the barrel 5, and with a shoulder 26 being formed at the rear edge of said plane.

Inner tube 23 has an external shape identical to that of the inner shape of external tube 22, has a threaded section 24 formed in its rear internal wall, and has a square-shouldered ridge 27, extending parallel to the axis of the tube on the part of the interior of the tube which has the same internal diameter along its length.

Figure 11:
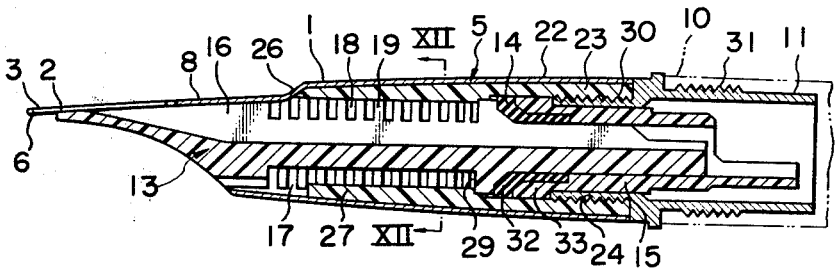
FIG. 11 is a longitudinal sectional view of the nib shown in FIG. 9.
Figure 12:
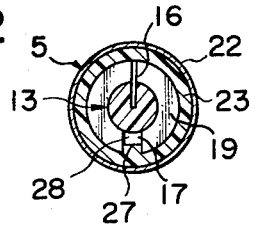
FIG. 12 is a sectional view taken along the line XII—XII of FIG. 11.

A nib assembly 12 is formed by inserting an ink-feed means into the nib 1 and fitting a rear barrel connector 11 to connect to the rear barrel 10 shown by the dashed-dotted line in FIG. 11.

As in the nib assemblies of the previously described embodiments, the ink-feed means of this embodiment consists of an ink feed member 13, a packing 14 and an ink reservoir connector 15. The ink feed member 13 has the external surfaces of the rims 19, which are left between the comb cuts 18, fitted against the interior of the inner tube 23, with a square groove 28 being cut in the exterior of the feed member 13 parallel to the axis thereof. The ink feed member 13 is inserted into inner tube 23 with said square groove 28 engaging the square-shouldered ridge 27 of the inner tube 23. The end 29 of the square groove 28 of the ink feed member 13 is aligned with the end of the square-shouldered ridge 27 of the inner tube 23 facing the rear end of barrel 5. An air duct 17 is formed between the bottom of square groove 28 and the upper surface of square-shouldered ridge 27.

A packing 14 and an ink-reservoir connector 15 are fitted to the rear of the ink feed member 13. A rear barrel connector 11 is screwed into the inner tube 23 using the engagement of the threaded section 30 on a coupling tube formed at one end of the connector 11 with the threaded section 24 of the inner tube 23, so that the ink-feed means is made immobile with respect to nib 1. The connector 11 has another threaded section 31 at the other end to connect to the rear barrel 10 shown by the dashed-dotted line in FIG. 11.

A description will be given here of the manner in which the packing 14, the ink reservoir-connector 15 and the rear barrel connector 11 are interlocked with one another. The tubular plastic packing 14 and the connector 15, which are fitted onto the rear of the ink feed 13, have flanges 32 and 33, respectively. The external circumference of flange 32 of the packing 14 is pressed against the internal surface of inner tube 23, while the exterior of the tubular part of the packing 14 is pressed against the internal surface of the connector 15. This structure causes the internal surface of packing 14 to be pressed against the ink feed member 13. Flange 33 of the connector 15 is located between one end of the rear barrel connector 11 and flange 32 of the packing 14, and is in contact with said end of the connector 11.

A slip-preventing section 21 is provided by forming a number of grooves formed around nib 1 at equal intervals, transverse to the axis of the nib.

The writing section 4 functions in the same manner as do the writing sections of the earlier embodiments. In addition, since the square-shouldered ridge 27 of inner tube 23 engages the square groove 28 formed in the ink feed 13, and since the end of the ridge 27 facing the rear end of the nib aligns itself with end 29 of the groove 28, the ink feed member 13 is controlled in its movement both along and around the axis of the nib. Accordingly, ink feed member 13 is positively and correctly located inside the nib 1. There is very little chance that the internal surface of the cap will come in contact with slit 2 formed in the nib 1, thus preventing ink drawn by slit 2 from contaminating the inner surface of the cap. This prevents eventual ink contamination of the nib 1 and the rear barrel 10.

Moreover, this assembly has the characteristic that, when the rear barrel connector 11 is screwed into the inner tube 23, the ink-reservoir connector 15 causes the packing 14 to press against the ink feed member 13, but does not press against flange 32 of said packing 14. This ensures that ink feed member 13 is under constant pressure which causes said feed member 13 to be pressed stably against the internal surface of inner tube 23, since flange 32 does not expand when the rear barrel connector 15 is screwed into the inner tube 23. Furthermore, even if the ink reservoir separates from the nib assembly while being twisted, the ink reservoir connector 15 slides and does not come off, preventing the rear barrel connector 11 from loosening.

The above description sets forth that square-shouldered ridge 27, which is formed in the barrel assembly 5, and square groove 28 formed in the ink feed member 13 engage each other. This engagement relationship can be reversed, and slight modifications can be made in the structure of the related parts and in their positional relationship, without causing any deterioration in the expected function.

Figure 13:
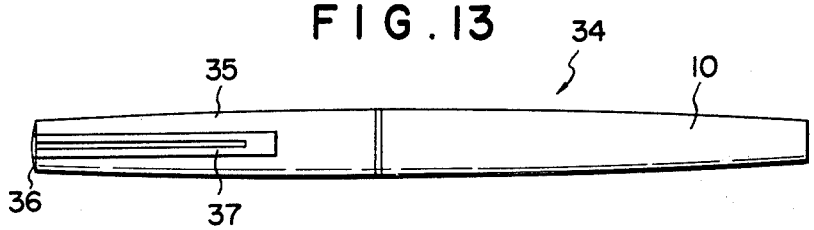
FIG. 13 is a plan view of a fountain pen with a cap covering the nib and incorporating the principles of this invention.
Figure 14:
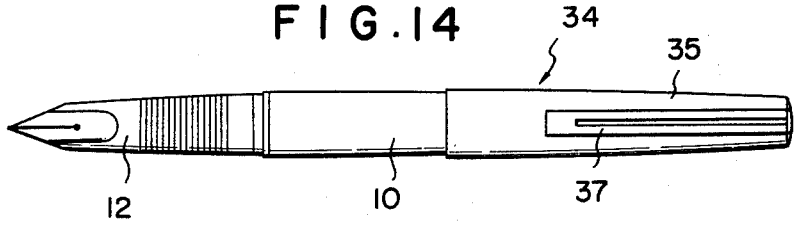
FIG. 14 is a plan view of the fountain pen shown in FIG. 13 with the cap fitted on the rear barrel.

FIG. 13 and FIG. 14 show a fountain pen assembled in accord with the principles of this invention.

The fountain pen 34 consists of a nib assembly 12, a rear barrel 10 and a cap 35 which can be fitted over said nib assembly 12 and onto the rear barrel 10.

The cap 35 is tubular, made of stainless steel or other suitable material, and is tapered, narrowing as one goes toward the top part 36. A clip 37 is fitted to said cap 35.

Figure 15:
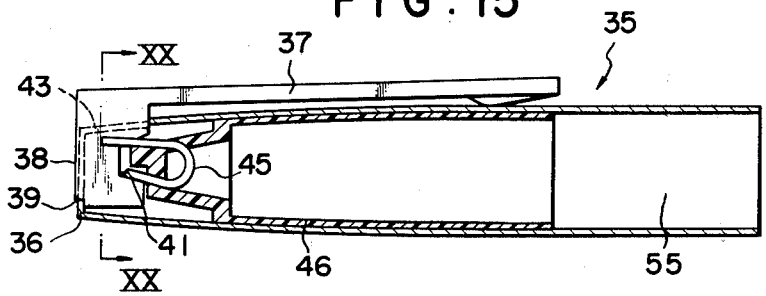
FIG. 15 is a longitudinal sectional view of the main part of the cap shown in FIG. 14.
Figure 21:
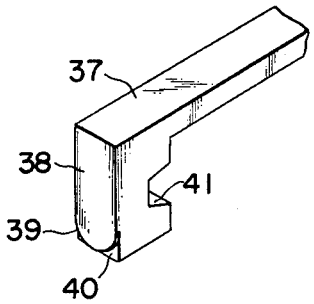
FIG. 21 is a perspective view of the main part of the clip, showing the upper surface of said clip.

As shown in FIG. 15, the upper half of clip 37 has a head section 38. A semicircular or rounded shoulder 39 is formed in the upper part of said head section 38, as most clearly shown in FIG. 21, so that a lowered surface 40 is formed, adjacent to said shoulder 39, at a level lower than the upper surface of said section 38. A spring-engaging notch 41 is formed in the lower surface of the head 38. Clip 37 can be produced by coining of a metal sheet.

Figure 16:
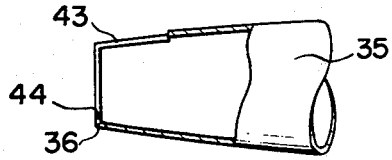
FIG. 16 is a fragmentary longitudinal section showing the top part of the cap with the clip removed.
Figure 18:
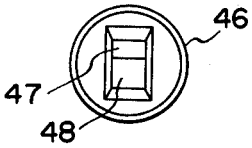
FIG. 18 is an end view of the inner cap shown in FIG. 17 as viewed from the left end.

As indicated in FIG. 16, a slot 43 is formed in the top part 36 of the cap 35 by cutting part of the side and top walls of the cap, wherein edge 44 of the slot 43 in the top wall is made semicircular and concentric with the semicircular shoulder 39.

The lowered surface 40 of head 38 which is inserted into the slot 43 is level with the lowest circumference of the semicircular edge 44 of slot 43 formed in the cap 35. The semicircular shoulder 39 is in abutment with said edge 44, while the head 38 projects out of the cap 35 in the directions both along and radial to the axis thereof with the surface 40 in engagement with the inner surface of the top wall of the cap 35.

Figure 17:
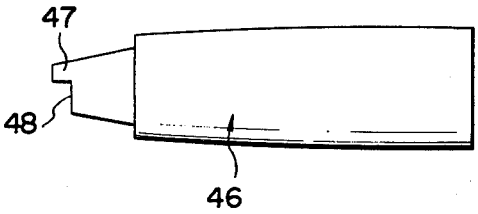
FIG. 17 is a side view of an inner cap fitted in the cap shown in FIG. 15.
Figure 19:
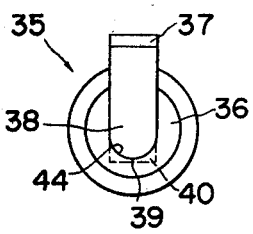
FIG. 19 is an end view of the cap.
Figure 20:
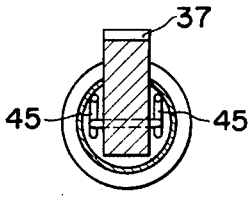
FIG. 20 is a sectional view taken along the line XX—XX of FIG. 15.

A spring 45 is made by processing a wire rod into a generally U shape with two side legs and a central portion connecting the legs and then bending the two side legs into a U shape as will be seen by referring to FIGS. 15 and 20. The central portion of the spring 45 is engaged with the spring-engaging notch 41 of the head 38 as shown in FIG. 15. The free ends of the spring are free but supported by the internal wall of cap 35, with the U-shaped legs of the spring bestriding the head 38 of clip 37. An inner cap made of plastic 46 and shown in FIG. 17 is inserted and fixed in cap 35. A tenon-shaped projection 47 is formed at the circular top end of the inner cap 46, wherein the tip of projection 47 and the lower step 48 which is formed in said projection 47 are located in the spring-engaging notch 41 and under the lower surface of the clip head 38, respectively, with a specific clearance.

Because of this assembly, the clip 37 is always pressed toward the interior of cap 35 by the elasticity of spring 45. In cases where the clip 37 is moved away from the cap 35 against the force of spring 45, the step 40 hits, and is supported by, the lowest circumferential section of the edge 44 of slot 43. THus, said step 40 functions as the fulcrum of clip 37. In this case, the head 38 hits the step 48 of the tenon-shaped projection 47, which causes the clip 37 to stop at a predetermined angle to the cap 35. Here, with the surface 40 contacting the internal surface of top wall 36, the clip moves properly and effectively without coming off the cap 35, even if the surface 40 of the clip head 38 does not have a large length in the direction perpendicular to the axis of the clip. In addition, the clip is prevented from shaking, due to the semicircular shoulder 39 fitting into the semicircular edge 44 of slot 43.

Figure 22:
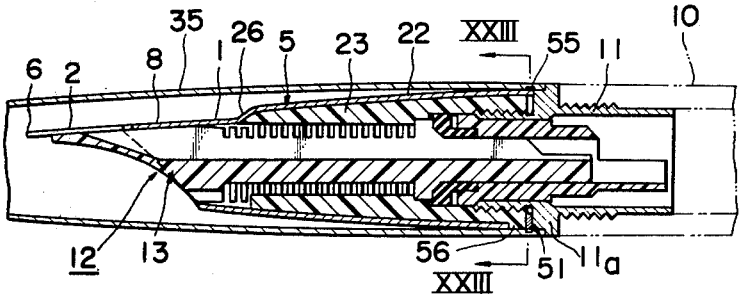
FIG. 22 is a longitudinal sectional view of part of the fountain pen with its nib engaging the cap.
Figure 23:
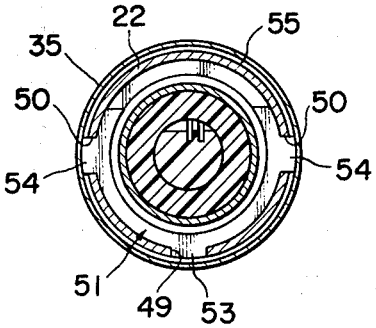
FIG. 23 is a sectional view taken along the line XXIII—XXIII of FIG. 22.
Figure 24:
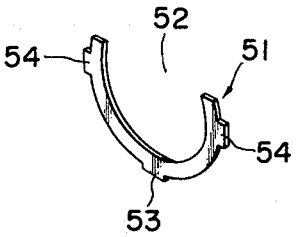
FIG. 24 is a perspective view of the cap-engaging device.

Referring to FIGS. 22 through 24, a description will be given of the manner of covering the nib assembly 12 with the cap 35.

Nib assembly 12 has a structure almost the same as that of the nib assembly shown in FIGS. 9–12, except that said nib assembly 12 has a laminated barrel 5 in which the rear end of the inner tube 23 is located slightly nearer to the front end of the nib 1 than is the rear end of the external tube 22. At the rear end of said external tube 22 three notches are formed: a central notch 49 and a pair of side notches 50 located at equal distances from the central notch 49, i.e., with all the three notches located at the rear circular edge of nib assembly 12.

Rear barrel connector 11 has a flange **11*a* at the middle. When it is screwed into the inner tube 23, a space is left between the external circumference of the front end of the flange 11*a* and the internal circumference of the rear end of external tube 22 to allow insertion of an open ring or arcuate spring 51 which functions as a cap-engaging device and is shown in FIG. 24. The arcuate spring 51** is produced from stainless steel or other appropriate material.

The arcuate spring 51 is made by processing a metal sheet. It has an open space 52, a fixing central projection 53 located at the opposite end of the diameter through the middle of said open space 52, and a pair of cap-engaging side projections 54, located at equal distances from said central projection 53, symmetrically arranged with respect to the diameter extending from the fixing projection 53 to the middle of the open space 52.

Projections 53 and 54 of spring 51 are inserted into notches 49 and 50, respectively so that the pair of projections 54 will project outwardly through the pair of notches 50 while the projection 53 will not project through the notch 49. A nib-assembly engaging groove 55 is formed in the inner wall of cap 35 which covers and engages nib assembly 12, and said groove 55 has an annular shape.

In engaging the cap 35 with the nib assembly 12; when the circular open edge of the cap 35 contacts the tips of projections 54 projecting beyond the outer surface of the external tube 22, the spring 51 contracts, and the tips of projections 54 descend to the level of the outer surface of the nib assembly 12 due to the projection 53 supporting the contracting spring. This allows the circular open edge of the cap 35 to pass projections 54. When the nib-assembly engaging groove 55 reaches said projections 54, the repulsive force of spring 51 causes the projections 54 to move outward, entering the groove 55 and engaging in it. To withdraw the cap, merely pulling it forcefully causes the groove 55 to pass projections 54 because the edge of the groove forces the tips of projections 54 inward. In this way, the cap is withdrawn, and the tips of projections 54 reappear above the surface of the nib assembly 12 due to the expanding force of the spring 51.

As is clear from the above description, this cap-engaging device is supported and locked by fixing projection 53 inserted in the projection receiving notch 49. This prevents the arcuate spring 51 from shaking at its center which, in turn, enables the cap-engaging projections 54 to project and withdraw through the projection receiving notches 50 formed in the exterior of nib assembly 12. This makes possible easy and smooth fitting of the cap to, and its removal from, the nib assembly 12, ensuring stable and controlled engagement between them.

The arcuate spring 51 need not necessarily be made by processing a metal sheet; use can be made of piano wire rods with suitable processing.

The movement of ink feed member 13 relative to nib 1 both along and around the axis of the tubular nib can be controlled completely, if the fixing projection receiving notch 49, which holds the fixing projection 53, is given an axially elongated shape, and a projection 56 is formed on the external circumference of the rear end of inner tube 23 so that said projection 56 is inserted into the projection receiving notch 49. The reason for this is that projection 56 locates the inner tube 23 with respect to the external tube 22.

Effects identical to those described above can be obtained when the engagement relationship between the projections and their receiving notches is reversed, and with the structures of related parts and their positional relationships modified slightly in accord with the reversed engagement relationship.

Thus, it will be appreciated that all of the cited objectives, advantages and features of this invention have been demonstrated as being obtainable in a highly practical tubular nib, and in a fountain pen having such a nib, and this tubular nib and fountain pen ensure both easy and faultless fountain-pen operation and also can be produced easily at low cost. It will be further understood that, although the invention has been described with respect to specific embodiments thereof, it is not limited to these embodiments, since various modifications of the invention will suggest themselves from the aforementioned description and are intended to be encompassed within the scope of the claims.

What is claimed is:

1. A tubular nib for a fountain pen, said nib having a tubular part and a single beak-shaped part projecting from one end of the tubular part and provided with a longitudinal slit extending generally parallel to the axis of said tubular part to form a writing section having a pointed end with two resilient tip portions on opposite sides of said slit which spread apart when a reaction force to a writing force exerted on said nib acts on said tip portions from a direction radially outwardly from said axis of said tubular part, said slit extending from said beak-shaped part into said tubular part, said tubular part having a grip spaced along the nib from the beak-shaped part toward the end remote from the beak-shaped part, said nib having a slit-widening inhibiting section for inhibiting said tip portions from spreading apart excessively even when a large writing force is exerted on said tubular nib, said slit-widening inhibiting section extending from the pointed end of the writing section toward the end of the nib remote from the beak-shaped part, and beyond the innermost end of the slit, said section having a radius of curvature, in cross-section, larger than that of said tubular part, and said nib having shoulders between the larger radius of curvature of the slit-widening inhibiting section and the remainder of the tubular part extending generally in the axial direction of the nib and a transverse shoulder between the slit-widening inhibiting section and the remainder of the tubular part, the slit-widening inhibiting section having a surface recessed relative to the surface of the tubular part.

2. A tubular nib as claimed in claim 1 wherein said tubular part of said nib has a slip-preventing section on the external surface thereof constituting said grip.

3. A fountain pen nib assembly comprising:

a tubular nib having a tubular part and a single beak-shaped section projecting from one end of the tubular part and provided with a longitudinal slit extending parallel to the axis of said tubular part to form a writing section having a pointed end with two resilient tip portions on opposite sides of said slit which spread apart when a reaction force to a writing force exerted on said nib acts on said tip portions from a direction radially outwardly from said axis of said tubular part, said slit extending from said beak-shaped section into said tubular part, said tubular part having a grip spaced along the nib from the beak-shaped section remote from the beak-shaped section, said nib having a slit-widening inhibiting section which extends from the pointed end of the writing section toward the end of the nib remote from the beak-shaped section and beyond the innermost end of said slit and which has a radius of curvature, as viewed in the axial direction of the tubular part, sufficiently larger than that of the tubular part to cause the formation of ridges between said slit-widening inhibiting section and the tubular part extending generally parallel to the axis of the nib and the formation of a transverse shoulder between said slit-widening inhibiting section and the tubular part for inhibiting said tip portions from spreading apart excessively even when a large writing force is exerted on said tubular nib, the slit-widening inhibiting section further having a surface recessed relative to the surface of the tubular part;

an ink-feed means inserted in, and covered by said tubular nib for leading ink from an ink reservoir to said slit; and a connecting member at the end of said tubular nib farthest from the writing section for connecting said tubular nib to a rear barrel.

4. A fountain pen nib assembly as claimed in claim 3 wherein said ink feed means comprises an ink feed member having an ink retaining space for containing overflowing ink which is in excess of the amount needed for writing and an ink sealing packing fitted between said ink feed member and said connecting member.

5. A fountain pen nib assembly as claimed in claim 3 or claim 4 further comprising an inner tube inserted into said nib, said ink feed means being fitted into said inner tube.

6. A fountain pen nib assembly as claimed in claim 5 further comprising a tubular connector for connecting to the ink reservoir mounted on the rear of the ink feed member, said tubular connector having a coupling tube threaded into a threaded section in the internal wall of the inner tube.

7. A fountain pen nib assembly as claimed in claim 4 wherein said ink feed means further comprises a tubular connector for connection to the ink reservoir and wherein ink sealing packing is fitted between the ink feed member and said tubular connector.

8. A fountain pen nib assembly as claimed in claim 7, wherein said ink sealing packing is in the form of a tube with an annular outer flange which is located between a flange on said tubular connector and a flange on said ink feed member.

9. A fountain pen nib assembly comprising:

a tubular nib having an inner tube inserted therein, said nib having a tubular part and a single beak-shaped part projecting from one end of the tubular part having a longitudinal slit therein extending generally parallel to the axis of said tubular part to form a writing section with a pointed end with two resilient tip portions on opposite sides of said slit which spread apart when a reaction force to a writing force exerted on said nib acts on said tip portions from a direction radially outwardly from said axis of said tubular part, said slit extending from said beak-shaped part into said tubular part, said tubular part having a grip spaced along the nib from the beak-shaped part toward the end remote from the beak-shaped part, said nib having a slit-widening inhibiting section which extends from the pointed end of the writing section toward the end of the nib remote from the beak-shaped part and beyond the innermost end of said slit and which has a radius of curvature, as viewed in the axial direction of the tubular part, sufficiently larger than that of the tubular part to cause formation of ridges between said slit-widening inhibiting section and the tubular part extending generally parallel to the axis of the nib and formation of a transverse shoulder between said slit-widening inhibiting section and the tubular part for inhibiting said tip portions from spreading apart excessively even when a large writing force is exerted on said tubular nib, the slit-widening inhibiting section further having a surface recessed relative to the surface of the tubular part, said inner tube being covered by the nib into which it is inserted, and a projection receiving means on the nib and the inner tube and engaging each other for holding the inner tube in the nib;

an ink feed means inserted in, and covered by said tubular nib for leading ink from an ink reservoir to said slit; and a connecting member at the end of said tubular nib farthest from said writing section for connecting said tubular nib to a rear barrel.

10. A fountain pen nib assembly comprising:

a tubular nib having an inner tube inserted therein, an ink feed means having an ink feed member inserted into said inner tube, said nib having a tubular part and a single beak-shaped part at one end of the tubular part having a longitudinal slit therein extending generally parallel to the axis of said tubular part to form a writing section with a pointed end with two resilient tip portions on opposite sides of said slit which spread apart when a reaction force to a writing force exerted on said nib acts on said tip portions from a direction radially outwardly from said axis to said tubular part, said slit extending from said beak-shaped part into said tubular part, said tubular part having a grip spaced along the nib from the beak-shaped part toward the end remote from the beak-shaped part, said nib having a slit-widening inhibiting section which extends from the pointed end of the writing section toward the end of the nib remote from the beak-shaped part and beyond the innermost end of said slit and which has a radius of curvature, as viewed in the axial direction of the tubular part, sufficiently larger than that of the tubular part to cause formation of ridges between said slit-widening inhibiting section and the tubular part extending generally parallel to the axis of the nib and formation of a transverse shoulder between said slit-widening inhibiting section and the tubular part for inhibiting said tip portions from spreading apart excessively even when a large writing force is exerted on said tubular nib, the slit-widening inhibiting section further having a surface recessed relative to the surface of the tubular part;

said inner tube being covered by the nib into which it is inserted, and a projection and a projection receiving means on the nib and the inner tube and engaging each other for holding the inner tube in the nib;

said ink feed member being for leading ink from an ink reservoir to said slit;

said inner tube and the ink feed member having a projection and a projection receiving means engaging each other for holding the ink feed member and the inner tube together; and a connecting member at the end of said tubular nib farthest from the writing section for connecting said tubular nib to a rear barrel.

11. A fountain pen comprising:

a tubular nib having a tubular part and a single beak-shaped part at one end of the tubular part and having a longitudinal slit extending generally parallel to the axis of said tubular part to form a writing section with a pointed end with two resilient tip portions on opposite sides of said slit which spread apart when a reaction force to a writing force exerted on said nib acts on said tip portions from a direction radially outwardly from said axis of said tubular part, said slit extending from said beak-shaped part into said tubular part, said tubular part having a grip spaced along the nib from the beak-shaped part toward the end remote from the beak-shaped part, means forming projection receiving notches in the wall at the end of said tubular part farthest from the writing section at circumferentially spaced positions, and a slit-widening inhibiting section which extends from the pointed end of the writing section toward the end of the nib remote from the beak-shaped part and beyond the innermost end of said slit and which has a radius of curvature, as viewed in the axial direction to the tubular part, sufficiently larger than that of the tubular part to cause formation of ridges between said slit-widening inhibiting section and the tubular part extending generally in the axial direction of said nib and formation of a transverse shoulder between said slit-widening inhibiting section and the tubular part for inhibiting said tip portions from spreading apart excessively even when a large writing force is exerted on said tubular nib, the slit-widening inhibiting section further having a surface recessed relative to the surface of the tubular part;

an ink feed means inserted in and covered by said tubular nib for leading ink from an ink reservoir to said slit;

a cap-engaging means in the form of an arcuate spring having a circumferential opening, a central fixing projection located at a position on the opposite end of a diameter from the middle of said opening, and two cap-engaging side projections at equal distances from said fixing projection and are symmetrically positioned with respect to the diameter extending from said fixing projection through the middle of said circumferential opening, said spring being disposed in the interior of the tubular nib, said nib having three projection-receiving notches for receiving said projections, the tips of the side projections normally projecting outwardly beyond the outer surface of the tubular nib; and a cap covering the nib and having the interior surface engaging said side projections for being held on said nib.

12. A fountain pen as claimed in claim 11 wherein the interior surface of said cap has an engaging section for engaging the cap engaging projections for enabling the cap to be interlooked with, and removed from, the tubular nib.

13. A fountain pen as claimed in claim 12, wherein the engaging section of said cap has a circumferential groove in the interior surface of the cap.

14. A fountain pen comprising:

a tubular nib having a tubular part and a beak-shaped part at one end of the tubular part and having a slit to form a writing section with a pointed end, said tubular part having a grip spaced along the nib from the beak-shaped part toward the end remote from the beak-shaped part, means forming projection-receiving notches in the wall at the end of said tubular part farthest from the writing section at circumferentially spaced positions, and a slit-widening inhibiting section which extends from the pointed end of the writing section to at least the innermost end of said slit and which has a radius of curvature, as viewed in the axial direction of the tubular part, sufficiently larger than that of the tubular part to cause formation of ridges between said slit-widening inhibiting section and the tubular part extending generally in the axial direction of said nib and formation of a transverse shoulder between said slit-widening inhibiting section and the tubular part;

an ink feed means inserted in and covered by said tubular nib for leading ink from an ink reservoir to said slit;

a cap-engaging means in the form of an arcuate spring having a circumferential opening, a central fixing projection located at a position on the opposite end of a diameter from the middle of said opening, and two cap-engaging side projections at equal distances from said fixing projection and are symmetrically positioned with respect to the diameter extending from said fixing projection through the middle of said circumferential opening, said spring being disposed in the interior of the tubular nib, said nib having three projection-receiving notches for receiving said projections, the tips of the side projections normally projecting outwardly beyond the outer surface of the tubular nib;

a cap covering the nib and having the interior surface engaging said side projections for being held on said nib; and a clip member on said cap, having a head at the upper part thereof, the upper surface of said head having a shoulder with a lowered surface which is lower than that of the upper surface of the head, said head having a notch in the under surface of said head;

said cap having a slot in the top and side walls of the cap, the head of said clip member being fitted in said slot with said shoulder in abutment with the edge of the slot located in the top wall of said cap and with said lowered surface in engagement with the inner surface of the top wall; and a spring having one end engaged in said notch in said clip member and having the other end fixed within the cap for pressing the clip member toward the outer surface of the side wall of the cap.

* * * * *